US007490600B2

(12) United States Patent
Kopp

(10) Patent No.: US 7,490,600 B2
(45) Date of Patent: Feb. 17, 2009

(54) BREAK-APART ASSEMBLY FOR SUPPORTING AN EXHAUST FLUE AND PROVIDING A CUMBUSTIBLE MATERIALS TOP AND A FIRE STOP

(76) Inventor: John G. Kopp, 2006 Via Vina, San Clemente, CA (US) 92673

( * ) Notice: Subject to any disclaimer, the term of this patent is extended or adjusted under 35 U.S.C. 154(b) by 254 days.

(21) Appl. No.: 11/394,435

(22) Filed: Apr. 1, 2006

(65) Prior Publication Data

US 2007/0227527 A1 Oct. 4, 2007

(51) Int. Cl.
*F16L 3/00* (2006.01)
*F16L 5/00* (2006.01)

(52) U.S. Cl. ..... 126/82; 126/307 R; 126/314; 126/317; 138/106; 138/107; 248/49; 248/56; 248/57; 248/73

(58) Field of Classification Search ..... 126/82, 126/307 R, 314, 317; 446/487, 488, 79, 446/80; 493/80; 285/19, 23, 24, 27; 138/106; 248/56, 57, 73
See application file for complete search history.

(56) References Cited

U.S. PATENT DOCUMENTS

| | | | | | |
|---|---|---|---|---|---|
| 34,743 | A | * | 3/1862 | Davis | 126/314 |
| 391,113 | A | * | 10/1888 | Brierly | 126/317 |
| 417,154 | A | * | 12/1889 | Oulberson | 126/314 |
| 442,965 | A | * | 12/1890 | Fairgrieve | 126/314 |
| 560,969 | A | * | 5/1896 | Burch | 165/103 |
| 576,899 | A | * | 2/1897 | Scott | 126/317 |
| 845,096 | A | * | 2/1907 | Kemble | 126/317 |
| 851,720 | A | | 4/1907 | Williamson | |
| 973,777 | A | | 10/1910 | Grissom | |
| 994,208 | A | * | 6/1911 | Snyder | 126/319 |
| 1,127,844 | A | | 2/1915 | Anderson | |
| 1,342,918 | A | | 6/1920 | Legg | |
| 1,399,748 | A | * | 12/1921 | Cheney | 126/317 |
| 1,555,480 | A | * | 9/1925 | Olcott | 126/317 |
| 2,140,441 | A | * | 12/1938 | Clark | 248/27.3 |
| 2,545,148 | A | * | 3/1951 | Jones | 126/293 |
| 2,648,326 | A | | 8/1953 | Epstein | |
| 2,648,511 | A | | 8/1953 | Epstein | |
| 2,706,395 | A | * | 4/1955 | McCrea | 52/219 |
| 2,918,053 | A | * | 12/1959 | Epstein | 126/307 R |
| 2,936,979 | A | * | 5/1960 | Epstein | 248/57 |

(Continued)

FOREIGN PATENT DOCUMENTS

FR 2847495 A * 5/2004

(Continued)

OTHER PUBLICATIONS

Firestop Spacer Simpson Dura-Vent 1995 Vacaville, California.

*Primary Examiner*—Kenneth B Rinehart
*Assistant Examiner*—Jorge Pereiro
(74) *Attorney, Agent, or Firm*—Patent Law & Venture Group; Gene Scott

(57) ABSTRACT

An exhaust flue support apparatus has an elongate flue mounting plate incorporating at least one longitudinal strengthening bead. The mounting plate engages, by break-off tabs, a securing strap, a flange plate, and a centering plate. The mounting plate, securing strap, flange plate and centering plate are made from a single piece of sheet metal.

4 Claims, 3 Drawing Sheets

U.S. PATENT DOCUMENTS 2,965,342 A * 12/1960 Goldstone ..... 248/57
3,004,740 A * 10/1961 Lane ..... 248/57
3,146,957 A * 9/1964 Totten ..... 362/458
3,308,808 A * 3/1967 Malafouris ..... 126/314
3,602,468 A * 8/1971 Stone ..... 248/57
3,809,350 A * 5/1974 Lane ..... 248/57
3,848,385 A * 11/1974 Thompson ..... 52/506.06
3,958,386 A * 5/1976 Pollock ..... 52/483.1
4,034,526 A * 7/1977 Deslaugiers ..... 52/220.2
D257,947 S 1/1981 Reynoso
4,291,905 A * 9/1981 Schrock ..... 285/192
4,424,837 A * 1/1984 Farrell ..... 141/284
4,543,942 A * 10/1985 Bauer et al. ..... 126/314
4,645,150 A * 2/1987 Taylor ..... 248/56
4,729,292 A * 3/1988 Marton ..... 454/284
4,762,272 A * 8/1988 Herrin ..... 229/125.08
4,804,133 A * 2/1989 Kiyokane ..... 229/116.4
4,813,691 A * 3/1989 Schoenborn ..... 277/598
4,848,043 A * 7/1989 Harbeke ..... 52/1
4,872,512 A * 10/1989 Multer ..... 169/51
4,897,974 A * 2/1990 Lane ..... 52/199
4,907,140 A * 3/1990 Overstreet ..... 362/162
4,930,681 A * 6/1990 Fultz et al. ..... 229/114
5,058,341 A * 10/1991 Harbeke, Jr. ..... 52/232
5,060,853 A * 10/1991 Gulliver et al. ..... 229/162.1
5,103,609 A * 4/1992 Thoreson et al. ..... 52/232
5,127,770 A * 7/1992 Ditcher et al. ..... 405/262
5,141,105 A * 8/1992 Maye ..... 211/135
5,222,657 A * 6/1993 Holland, Jr. ..... 229/103
5,257,641 A * 11/1993 Elsbury et al. ..... 137/79
5,264,996 A * 11/1993 Bele et al. ..... 362/162
5,337,948 A * 8/1994 Newsome et al. ..... 229/120.15
5,400,955 A * 3/1995 Coalier et al. ..... 229/108
5,421,127 A * 6/1995 Stefely ..... 52/1
5,429,116 A * 7/1995 Brown ..... 126/299 D
5,454,756 A * 10/1995 Ludwig ..... 454/296
5,465,961 A * 11/1995 Burtch ..... 273/317.3
5,515,595 A * 5/1996 Kurz ..... 29/509
5,592,885 A * 1/1997 Young et al. ..... 108/51.3
5,655,944 A * 8/1997 Fusselman ..... 446/67
5,848,548 A * 12/1998 Latour et al. ..... 72/325
5,887,396 A * 3/1999 Thoreson ..... 52/232
6,179,437 B1 * 1/2001 Hardy et al. ..... 362/162
6,230,881 B1 * 5/2001 Collura ..... 206/175
6,415,575 B1 * 7/2002 Thompson ..... 52/712
6,488,579 B2 * 12/2002 Larson et al. ..... 454/354
6,604,993 B1 * 8/2003 Boniface ..... 454/186
6,647,977 B2 * 11/2003 Lesage ..... 126/85 B
7,122,739 B2 * 10/2006 Franks, Jr. ..... 174/51
7,128,206 B2 * 10/2006 Kohler ..... 206/176
2002/0195097 A1 * 12/2002 Lesage ..... 126/85 B
2003/0042371 A1 * 3/2003 McCahill et al. ..... 248/57
2003/0134588 A1 * 7/2003 Larson et al. ..... 454/354
2005/0000510 A1 * 1/2005 Holt et al. ..... 126/500
2005/0003754 A1 * 1/2005 Pilger ..... 454/292

FOREIGN PATENT DOCUMENTS

GB 2123868 A * 2/1984
GB 2195678 A * 4/1988

* cited by examiner

BREAK-APART ASSEMBLY FOR SUPPORTING AN EXHAUST FLUE AND PROVIDING A CUMBUSTIBLE MATERIALS TOP AND A FIRE STOP

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to the support and physical centering of furnace and other exhaust flue pipes and vents and more particularly to an apparatus capable of providing a plurality of connected but easily broken apart sheet metal portions for accomplishing this task in a manner for meeting manufacturers required clearances to combustibles.

2. Description of Related Art Including Information Disclosed Under 37 CFR 1.97 and 1.98

Reynoso, U.S. Des. Pat. No. 257947 discloses a design for a bracket for mounting a heater vent pipe between joists and rafters. Williamson, U.S. Pat. No. 851,720 discloses a flue support consisting of two parallel spaced U-shaped metal straps having their extremities turned outwardly at right angles in a common plane, and a pair of independently formed parallel spaced cross-straps, disposed upon the web portions of the U-shaped straps and having their ends turned downwardly against the outer edges of the webs of the U-shaped straps, whereby longitudinal displacement of the cross-straps from the U-shaped straps is prevented. Grissom, U.S. Pat. No. 973,777 discloses a flue base, a pair of supports spaced from each other, each support being of substantially U-shape and having outwardly bent and down-turned hook like ends for engagement with adjacent joists, and a centrally perforated flat plate normally resting upon the cross connecting portions of the supports and having notches formed in opposite side edges receiving the vertical leg portions of the supports, whereby the plate will be held against displacement with respect to the latter without the use of fasteners. Anderson, U.S. Pat. No. 1,127,844 discloses a device comprising in combination a pair of U-shaped stirrups the legs of which are bent to hook formation at their terminals to adapt them to engage over spaced supports, the stirrups lying in space relation to each other, bars extending between the stirrups with their ends resting upon the stirrups, the stirrups and the bars together comprising an open, rectangular and continuous support and a sheet metal plate supported upon the bars and the stirrups and completely overlying the bars and the horizontal portions of the stirrups the plate serving as a base and a closure for the bottom of a brick flue, the bars and the stirrups underlying the line of the bricks of which the flue is made and the plate having an opening formed therein for the reception of a stove pipe. Legg, U.S. Pat. No. 1,342,918 discloses a flue with an open bottom having a pipe entering the open end thereof, of a flue pan arranged beneath the open bottom of the flue provided with a central aperture adapted to receive the pipe and a tubular member secured to the pan and extending upwardly into the flue surrounding the pipe, the tubular member being provided on the upper end thereof with a resilient flange engaging the pipe. Epstein, U.S. Pat. No. 2,648,326 discloses a spacer comprising: an elongated strip of deformable sheet metal formed with a longitudinal series of transverse extensions severed from the strip along their opposite sides and one end only, and bent outward from the strip along the other end which extensions are additionally bent adjacent the first end at a distance from the strip beyond the deformable limits of the strip-secured metal to provide footing portions collectively adapted to abut against the perimeter of a structure around which the strip may be wound so as to space the same apart therefrom, and means for fastening the wound strip to a supporting structure the strip of metal having longitudinally extending dimples stiffening the strip at the junctures of the respective extensions at their other ends, the stiffening dimples terminating at stations spaced from the junctures and defining unstiffened transverse bend lines for the strip between the extensions. Epstein, U.S. Pat. No. 2,648,511 discloses a hanger for a vertical vent pipe, the hanger comprising a vent pot means having a side and a bottom to receive the lower end of a support pipe, the hanger further comprising bracket means adapted to be supported on adjacent ceiling joists, hanger bar means supported on the bracket means, and the pot supported on the hanger bar means, the bracket means comprising a sheet metal body including a surface for securement against the side of one of the joists and having means offset from the plane of the surface, vertical slots formed in the offset means, the slots each having a downwardly tapered upper end portion and an enlarged lower end potion, the hanger bar means being horizontally supportable on the bracket means and having compressible end portions normally thicker than the slots at their narrowest tapered portions adapted to be snapped downwardly into individual slots, the bar means being longitudinally adjustable in the slots, the pot including a bottom and a side wall, the side wall of the pot having receiving means for the bar, the bar means being longitudinally slidable in the bar receiving means, the bar receiving means including portions normally frictionally gripping the bar. Goldstone, U.S. Pat. No. 2,965,342 discloses a vent pipe support including a frame adapted to be secured to spaced portions of a building, the frame including spaced members adapted to extend between the spaced building portions; a pipe supporting bucket having opposed, generally parallel end walls; brackets secured to the end walls and spaced therefrom in generally parallel relation thereto to provide guideways between the brackets and end walls to receive the spaced members with the bracket s and bucket supported on the space members, the sides of each guideway being defined by an end wall and a bracket secured to the end wall. Lane, U.S. Pat. No. 3,004,740 discloses a hanger for flue pipes comprising, a generally rectangular frame structure adapted to span a pair of spaced beams and to be secured thereto, a horizontally disposed clamping ring adapted to receive and hold a vertically disposed flue pipe against axial movements, and a plurality of circumferentially spaced centering brackets interposed between the clamping ring and the frame structure the brackets including vertical ears secured to the clamping ring, horizontal ears detachably secured to the frame structure, and angular body portions, the body portions defining radially inwardly projecting elements which are adapted to engage circumferentially space portions of a flue pipe in axially space relation to the clamping ring, whereby to hold the flue against angular movements with respect to the axis of the clamping ring. Stone, U.S. Pat. No. 3,602,468 discloses a support assembly for securing a prefabricated metal chimney or the like to a sloped roof and comprising a pair of bracket members adapted to be fixed to rafters on opposite sides of the chimney, each being adjustably connected to a plate member which is fixed to the chimney so that the chimney can be held vertically despite the degree of roof slope. Lane, U.S. Pat. No. 3,809,350 discloses a readily applicable device for use when the user is called upon to install a sheet material vent pipe. It comprises a simple adapter plate having a central opening for insertable and adjustable passage of a conventional type vent pipe, the apertured portion of the plate being encompassed by overhanging coordinating tabs. These tabs have upwardly flexed or canted inner ends which are slightly resilient and which embrace and yieldingly as well as retentively engage that portion of the vent pipe surrounded thereby.

The related art described above discloses several methods known and in use for engaging and securing a vent flue. However, the prior art fails to disclose a single interconnected set of securement portions that are fabricated from a single piece of sheet metal and which may be easily broken apart in securing a flue vent while meeting fire code regulations for openings within certain building structures. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

The prior art described above and well known common practice in the construction trades provides methods and means for securing flue vents and pipes of all types. However these techniques and parts are lacking in that they require the purchasing and inventorying of several disparate parts, picking and carrying these parts to a job site and then applying them in tight quarters with little space for setting parts down and for working. Furthermore, the use of separate parts can be expensive. The present invention apparatus overcomes these difficulties as will be shown. Described herein is an exhaust flue support apparatus made up an elongate flue mounting plate incorporating at least one longitudinal strengthening bead. The mounting plate engages, by break-off tabs, a securing strap, a flange plate, and a centering plate. The mounting plate, securing strap, flange plate and centering plate are made from a single piece of sheet metal. The apparatus functions as a combustible material stop in that flanges extend laterally to combustible materials that are typically laid for flooring, ceiling and roofing structures. The apparatus also functions as a fire stop in that critical components are tight fitting and made of metal sheet.

The fact that the parts are made at the same time by the same processes of forming and punching, and that they are connected as a single sheet enables low cost and simplified inventorying and convenient carrying to the job site, setting at the job site, i.e. standing it up vertically to take up almost no floor space room when in tight quarters is an example of a truly significant advance in the art.

A primary objective inherent in the above described apparatus and method of use is to provide advantages not taught by the prior art.

Another objective is to provide the several parts necessary to complete a flue stabilization and centering in an interconnected sheet metal format where separate parts may be broken away for use in completing the job.

A further objective is to manufacture all of the parts needed for a particular construction job or operation from a single piece of sheet metal by fabrication steps that finish all of the parts at the same time and without separating them.

A still further objective is to provide a set of parts for a construction job where the parts are interconnected, but easily broken away from each other in order to complete the job, yet are initially joined so as to be more conveniently inventoried, stored, carried to the job site and used at the job site.

A yet further objective is to prepare a plurality of sheet metal parts from a single section of sheet metal with small tabs attaching the parts together so that they may be easily separated by work hardening the tabs by manual bending until they break apart.

A still further objective is to provide a set of sheet metal parts that are able to stabilize and hold a flue in place without movement in the vertical or horizontal directions and further is able to meet the vent manufacturers required clearances to combustibles.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 4:
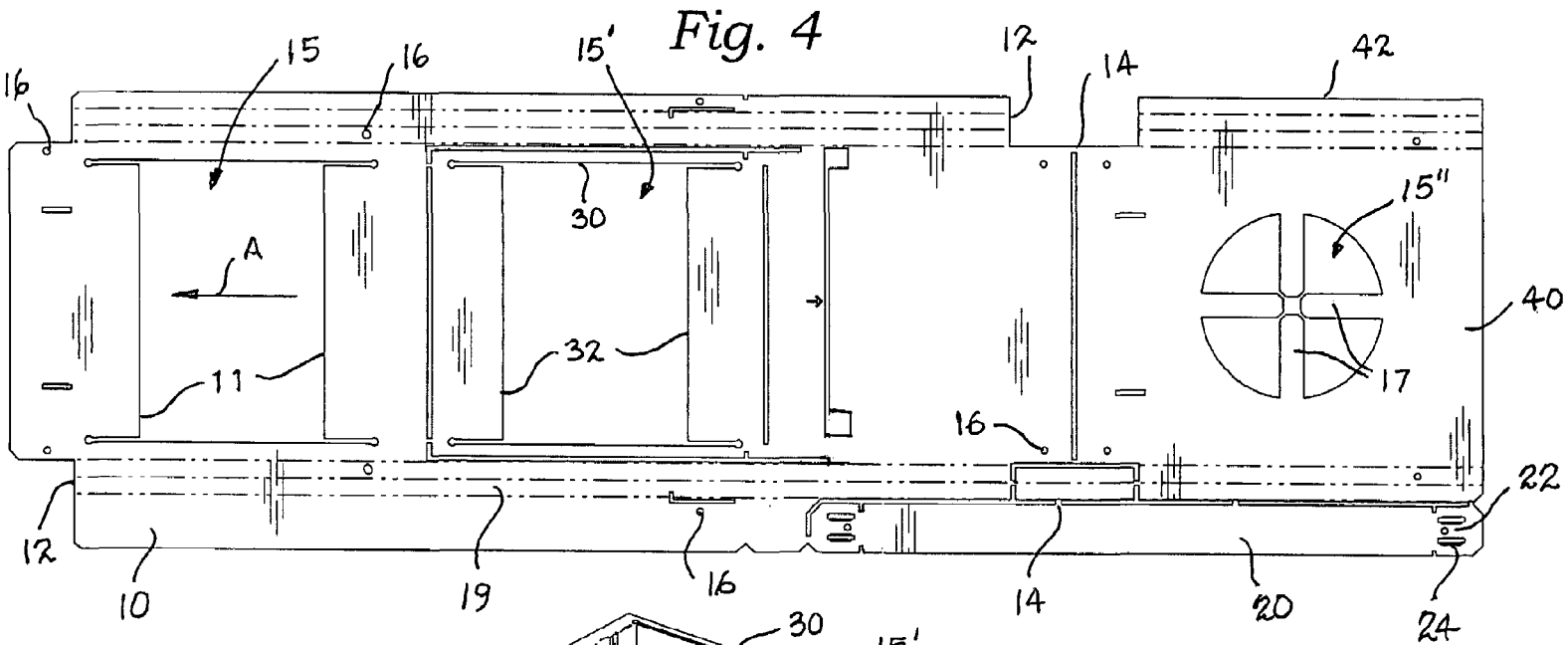
FIG. 4 is a plan view thereof prior to bending.
Figure 5:
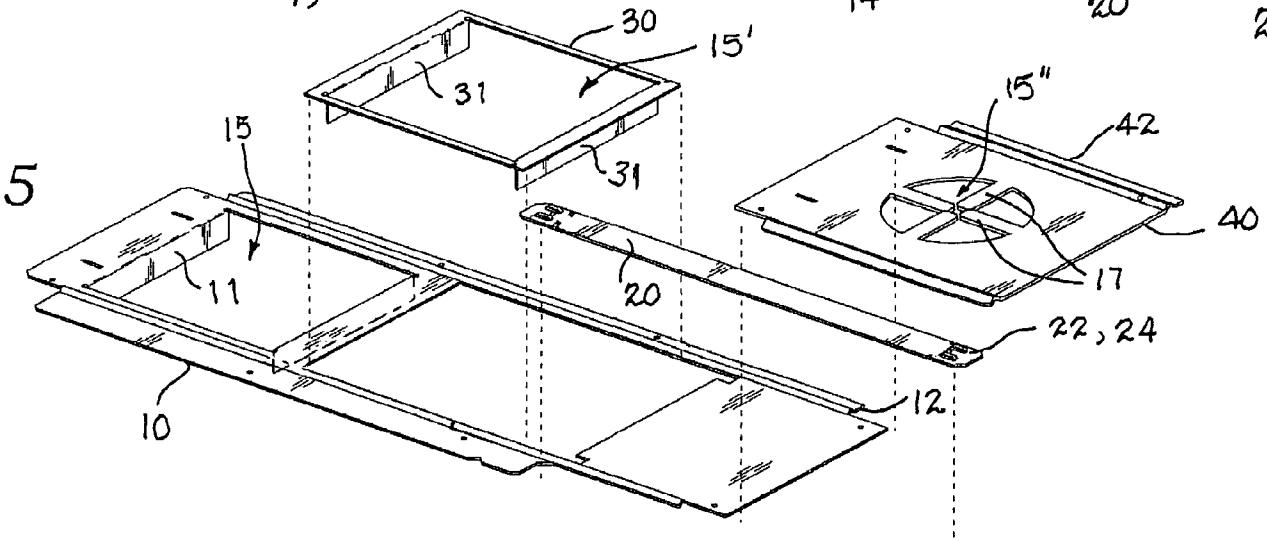
FIG. 5 is a perspective exploded view thereof showing the manner of breaking the unitary assembly as manufactured apart.

Described now in detail is a first embodiment of an exhaust flue support apparatus, the subject of this application. This apparatus comprises an elongate flue mounting plate 10 defining a longitudinal direction, see arrow "A." The mounting plate 10 incorporates at least one longitudinal, spaced-apart, strengthening beads 12 (FIG. 4) which may be V-shaped or semicircular. Other shapes are possible as well. The purpose of these beads 12 is to prevent lateral bending of the mounting plate 10, which is necessary for it to perform its function. The mounting plate 10 is engaged by break-off tabs 14 with a securing strap 20, a flange plate 30, and a centering plate 40 and these four parts: 10, 20, 30 and 40 are arranged in planar juxtaposition as shown in FIGS. 4 and 5. These four parts 10, 20, 30 and 40 are preferably made from a single flat piece of 24 gauge galvanized steel sheet metal and are preferably fabricated at the same time through punching and bending operations well known in the art.

Figure 1:
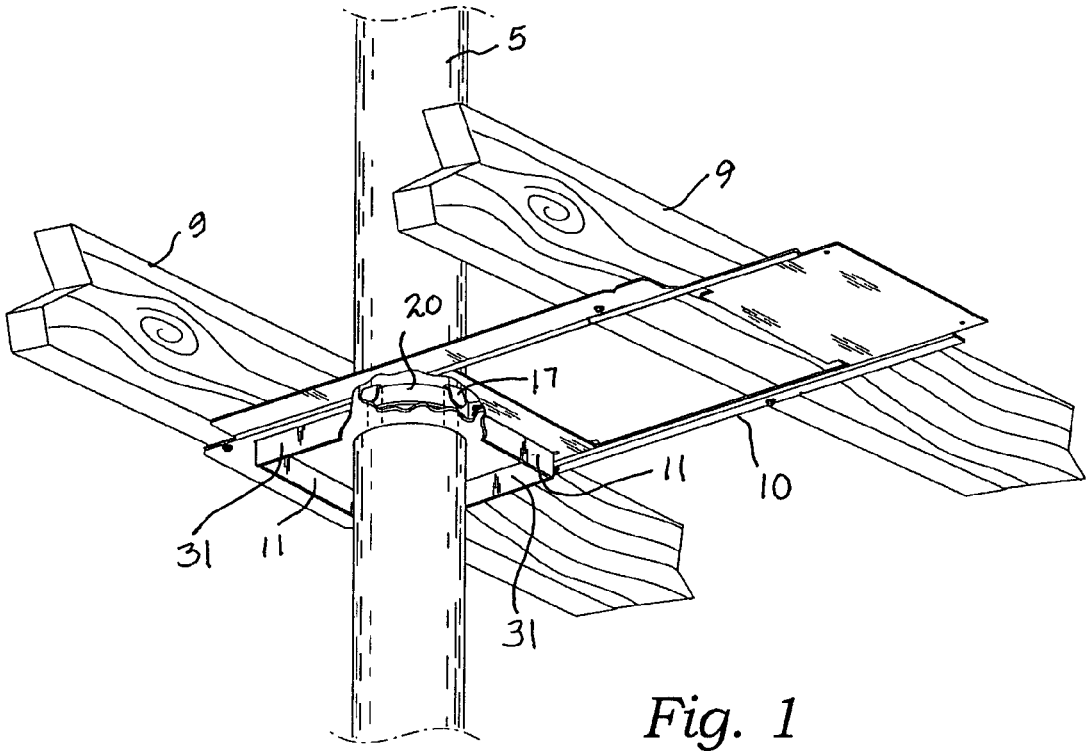
FIG. 1 is a perspective view of the presently described apparatus as assembled and mounted and as seen from below.

The mounting plate 10 provides plural mounting holes 16 so that it may be mounted by common hardware fasteners as shown in FIG. 1. The mounting plate 10 also provides a first flue access hole 15 as best seen in FIGS. 4 and 5. The mounting plate 10 also provides a first pair of opposing flanges 11, the flanges extending from the first flue access hole 15 at right angles to the mounting plate 10 and oriented laterally across the plate 10 as seen in FIG. 5.

The securing strap 20 provides fastener holes or apertures 22 at terminal ends thereof for fastening the securing strap 20 to itself as will be described and shown. Preferably, the terminal ends of the securing strap 20 also each provides an anti-turn element 24 for securing a fastener such as a nut. Such an anti-turn element 24 is preferably a pair of spaced apart raised portions produced by a lancing or dimpling operation, and are placed with the aperture 22 between them. The securing strap 20 is of a length sufficient for encircling a flue supported by the apparatus as shown in FIG. 1.

The flange plate 30 provides a second flue access hole 15' and a second pair of opposing flanges 31, the second opposing flanges extending from the second flue access hole 15' at right angles to the flange plate 30. The second opposing flanges 31 are positionable within the first flue access hole 15 when the flange plate 30 is rotated by 90 degrees from its nominal position as originally set in the mounting plate 10. When this is accomplished the ends of the second opposing flanges of the flange plate 30 are in abutting juxtaposition with the first opposing flanges 11 of the mounting plate and are therefore secure against flame intrusion. This is best seen in FIG. 1.

Figure 2:
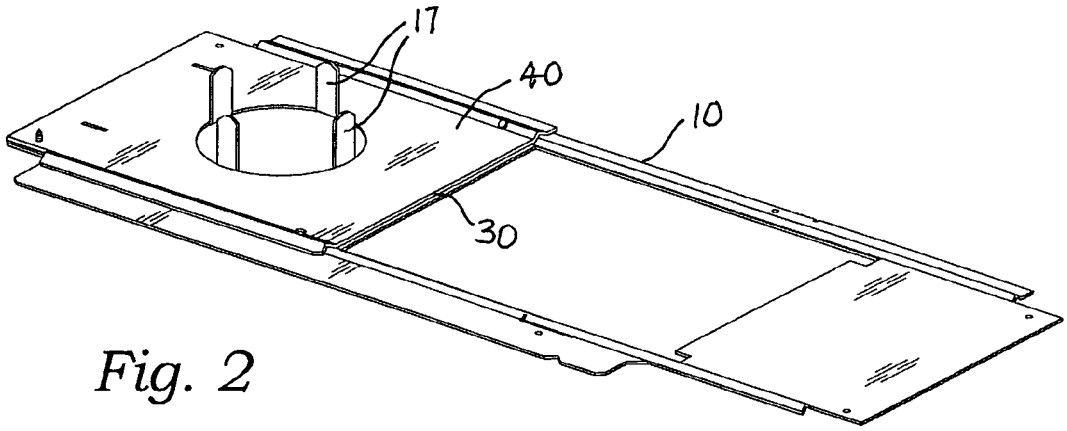
FIG. 2 is a perspective view thereof as seen from above.

The centering plate 40 provides a third flue access hole 15" circular in shape for a round flue and square or rectangular in shape for a non-round flue (not shown). This third hole 15" has at least one, and preferably four, contiguous strapping-tabs 17 extending into the flue access hole 15" and which therefore may be bent at right angles as shown in FIG. 2. The centering plate further comprises at least one further of the strengthening beads denoted here by numeral 42 and positioned for nesting with at least one of the strengthening beads 12 of the mounting plate 10 when the first 15 and third 15" flue access holes are coaxially positioned as in shown in FIG. 2 and plates 10 and 40 are adjacent as shown in FIG. 2.

Figure 3:
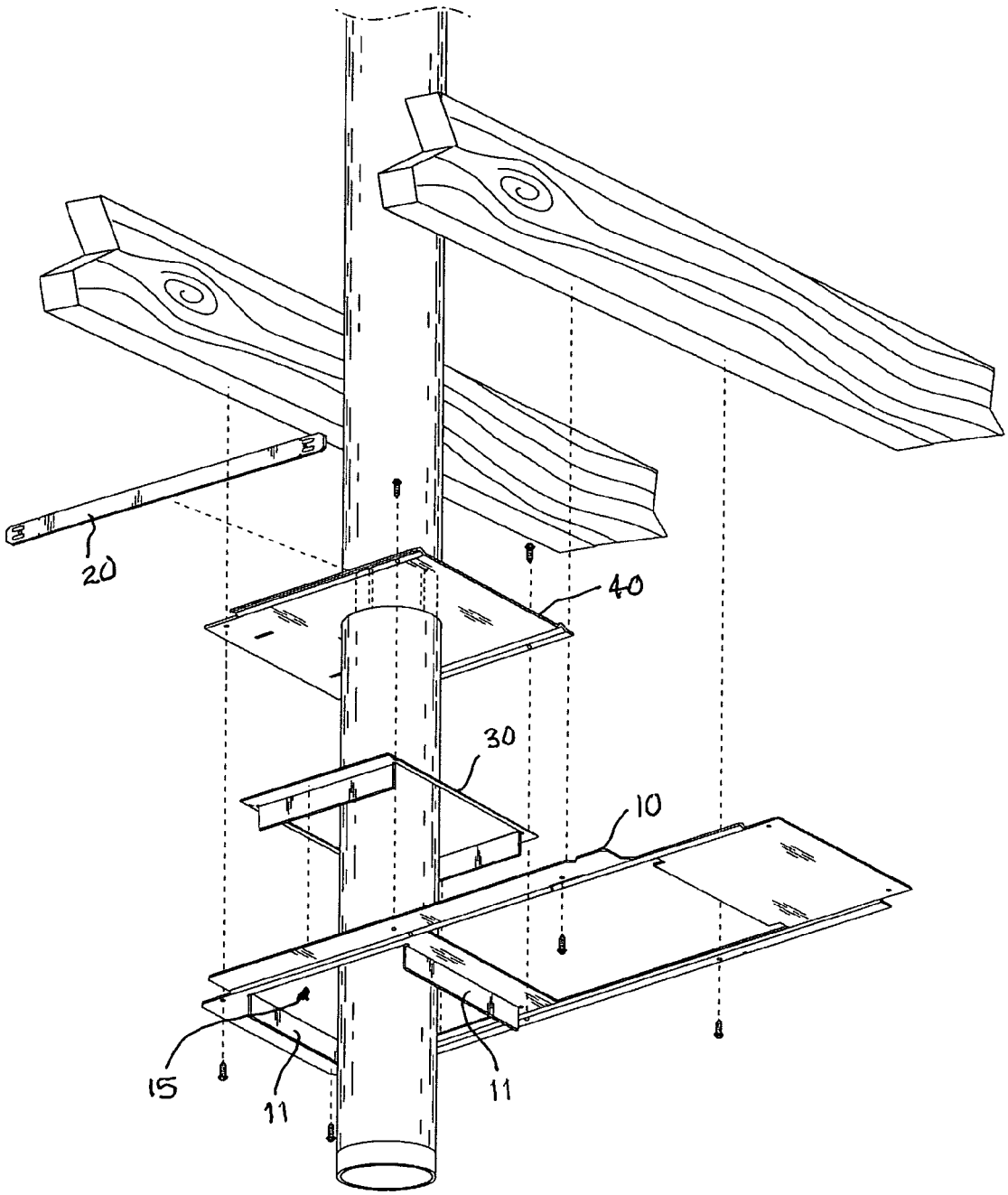
FIG. 3 is an exploded perspective view thereof.

In use, as shown in FIG. 1, the arrangement of the parts shown in FIG. 4, are broken apart and positioned as shown in FIG. 3; then mounted as shown in FIG. 1. FIG. 2 shows the assembly of plates 10, 30 and 40 prior to being mounted. Because hole 15" in plate 40 is tight against the flue 5 and the flanges 11 and 31 are abutting, the assembly is able to meet UL(cm) standards for a fire stop, and also these clearances meet the flue manufacturers specified requirements. The flanges 11 and 31 stop the dry wall or other surface material from being laid closer to the flue 5 then is required by fire and building codes.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An exhaust flue supporting apparatus comprising: a mounting plate, a flange plate and a centering plate; the plates integrally-joined by break-off tabs as a single planar metal sheet; the mounting plate having a first rectangular flue access hole and a first pair of opposing integral flanges, the first flanges movable into right angle positions relative to the planar metal sheet; the flange plate having a second rectangular flue access hole and a second pair of opposing integral flanges, the second flanges movable into right angle positions relative to the planar metal sheet; the second pair of flanges configured and sized to enter the first flue access hole when the flange plate is separated from the planar metal sheet and positioned with the first and second access holes in coincidence; the centering plate having a third flue access hole and a strapping-tab, the strapping-tab movable into a right angle position relative to the planar metal sheet; the mounting plate, flange plate and securing plate configured and sized for mutual abutment about an exhaust flue positioned within the first, second and third flue access holes, when the plates are separated at the break-off tabs and the first and second pair of flanges and the strapping-tab are moved to right angle positions relative to the planar metal sheet.

2. The exhaust flue supporting apparatus of claim 1 further comprising a planar securing strap joined by the break-off tabs to the planar sheet, the securing strap sized and configured for encircling the exhaust flue and the strapping-tab.

3. The supporting apparatus of claim 1 further comprising a planar securing strap joined by the break-off tabs to the planar sheet, the securing strap encircling the exhaust flue and the strapping-tab.

4. A supporting apparatus comprising: an exhaust flue and a mounting plate, a flange plate and a centering plate; the plates integrally-joined by break-off tabs as a single planar metal sheet; the mounting plate having a first rectangular flue access hole and a first pair of opposing integral flanges, the first flanges movable into right angle positions relative to the planar metal sheet; the flange plate having a second rectangular flue access hole and a second pair of opposing integral flanges, the second flanges movable into right angle positions relative to the planar metal sheet; the second pair of flanges configured and sized to enter the first flue access hole when the flange plate is separated from the planar metal sheet and positioned with the first and second access holes in coincidence; the centering plate having a third flue access hole and a strapping-tab, the strapping-tab movable into a right angle position relative to the planar metal sheet; the mounting plate, flange plate and securing plate separated from the planar metal sheet and positioned in mutual abutment about the exhaust flue with the exhaust flue positioned within the first, second and third flue access holes.

* * * * *